United States Patent [19]

Fairman

[11] 3,958,367

[45] May 25, 1976

[54] OVERHEAD GARAGE DOOR SPRING SAFETY DEVICE

[76] Inventor: William Fairman, 8004 Outlook Drive, Prairie Village, Kans. 66208

[22] Filed: Dec. 26, 1974

[21] Appl. No.: 536,453

[52] U.S. Cl. ..... 49/197; 267/74

[51] Int. Cl.[2] ..... E05D 15/22

[58] Field of Search ..... 49/197, 203, 206; 267/69, 73, 74

[56] References Cited

UNITED STATES PATENTS

| | | | |
|---|---|---|---|
| 2,702,082 | 2/1955 | Wolf | 267/74 X |
| 2,758,833 | 8/1956 | Harbert | 267/74 X |
| 3,429,072 | 2/1969 | Sammons | 267/74 X |
| 3,575,404 | 1/1969 | Wesch | 267/74 |

FOREIGN PATENTS OR APPLICATIONS

| | | | |
|---|---|---|---|
| 426,810 | 4/1935 | United Kingdom | 267/69 |

*Primary Examiner*—Kenneth Downey

*Attorney, Agent, or Firm*—Fishburn, Gold & Litman

[57] ABSTRACT

A safety device for use in combination with elongated coil springs substantially balancing the door weight for ease of opening and adapted to urge said door toward an open position after partial opening movement. The safety device includes an elongated flexible member extending longitudinally substantially axially through the elongated spring with ends thereof beyond the spring ends as with one end fixedly mounted adjacent a fixed end of the spring and the other end thereof resiliently mounted adjacent the other end of the spring whereby separate portions of the spring will be retained on the elongated flexible member in the event of breakage of the coil spring.

2 Claims, 5 Drawing Figures

OVERHEAD GARAGE DOOR SPRING SAFETY DEVICE

The present invention relates to overhead garage doors and more particularly to a safety device therefor adapted to retain separate portions of a coil spring balance in the event of breakage of the door spring. In most overhead garage door structures, the door moves on tracks between open and closed positions. In position for closing the door opening, the door is substantially upright and in the open position, the door is generally horizontal on a level above the top of the door opening and inwardly of the garage or like structure, the door structure has tracks on each side of the door path and the door has rollers or the like operating in the track to guide the door in its path. Such structures have springs as counter balances to ease the effort for moving the door. Usually there are cables or small wire rope and pulleys connecting the door and springs on each side so the spring force through the cables acts on the bottom portion of the door. The springs are usually alongside the horizontal upper portion of the door tracks with one end fixedly connected toward the end thereof remote from the door opening and the other end connected to a pulley having the door cable operating thereover. Such springs are in the nature of 2 to 3 inches in diameter and 2 feet long in contracted condition. Such springs break usually when elongated and the pieces may be propelled at substantial force causing injury to vehicles or persons in their path. The cause of breakage of the springs may be fatigue of metal or by other causes, but breakage occurs when the springs are elongated and breakage results in the parts being propelled at high speed capable of causing substantial damage and injury.

The principal objects of the present invention are: to provide a safety device adapted to retain separate portions of an overhead garage door spring in the event of breakage of the spring; to provide such a safety device including an elongated flexible member extending through the door spring and having at least one end thereof resiliently mounted to absorb shock of breakage of the spring; to provide such a safety device adapted to protect persons and property from flying separate portions of the door spring if the spring breaks; and to provide such a safety device which is simple to install, durable in construction, economical to manufacture, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the overhead garage door safety device.

Figure 1:
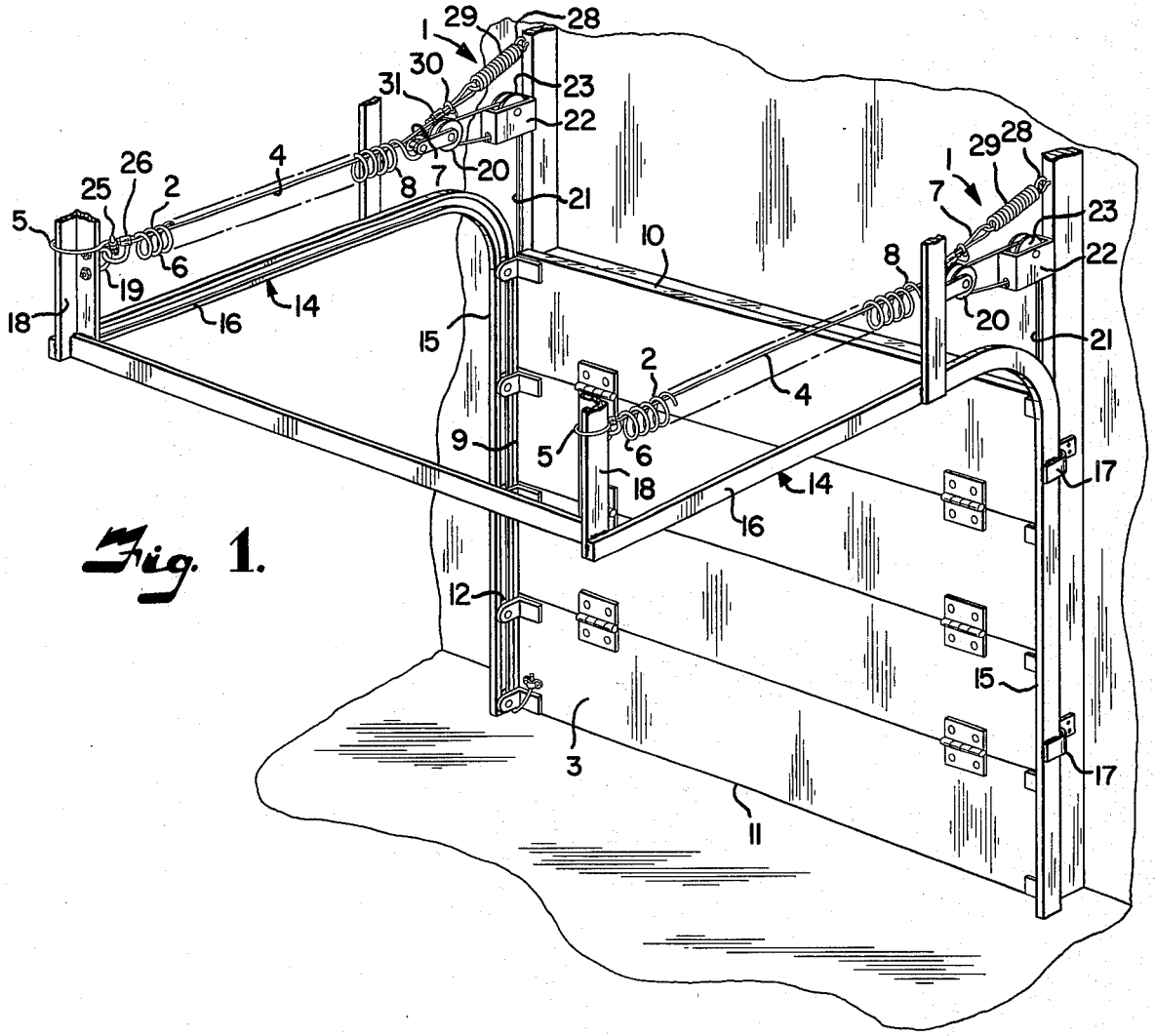
FIG. 1 is a perspective view of an overhead garage door and showing a door spring safety device embodying features of the present invention.
Figure 2:
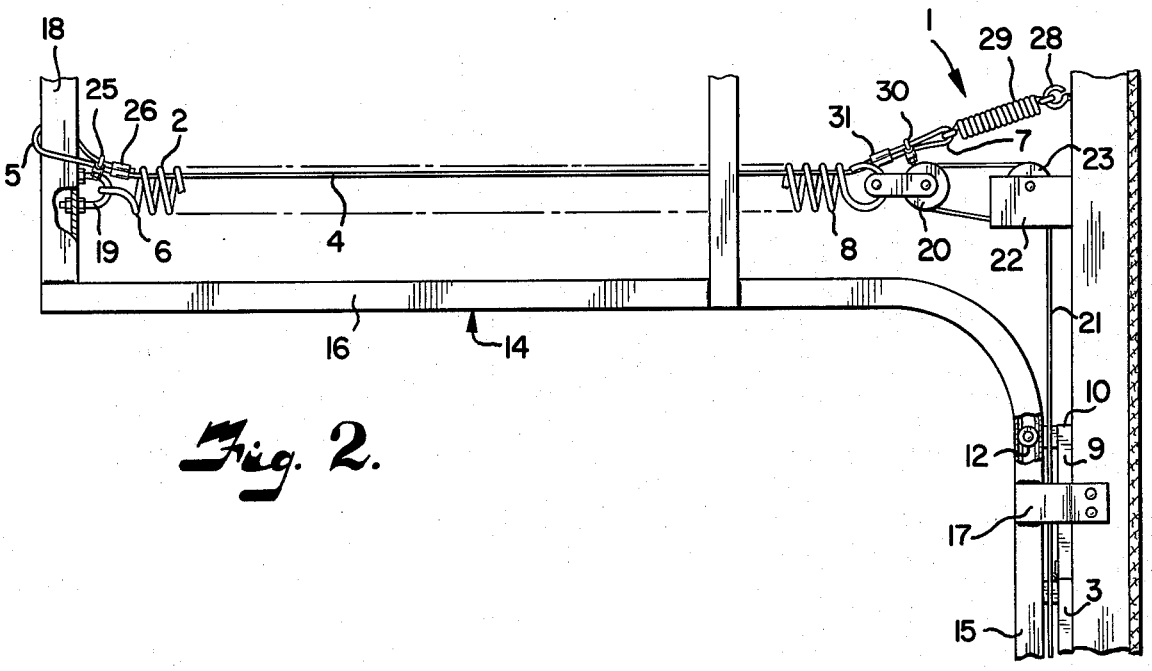
FIG. 2 is a side elevational view of the overhead garage door shown in a closed position.
Figure 3:
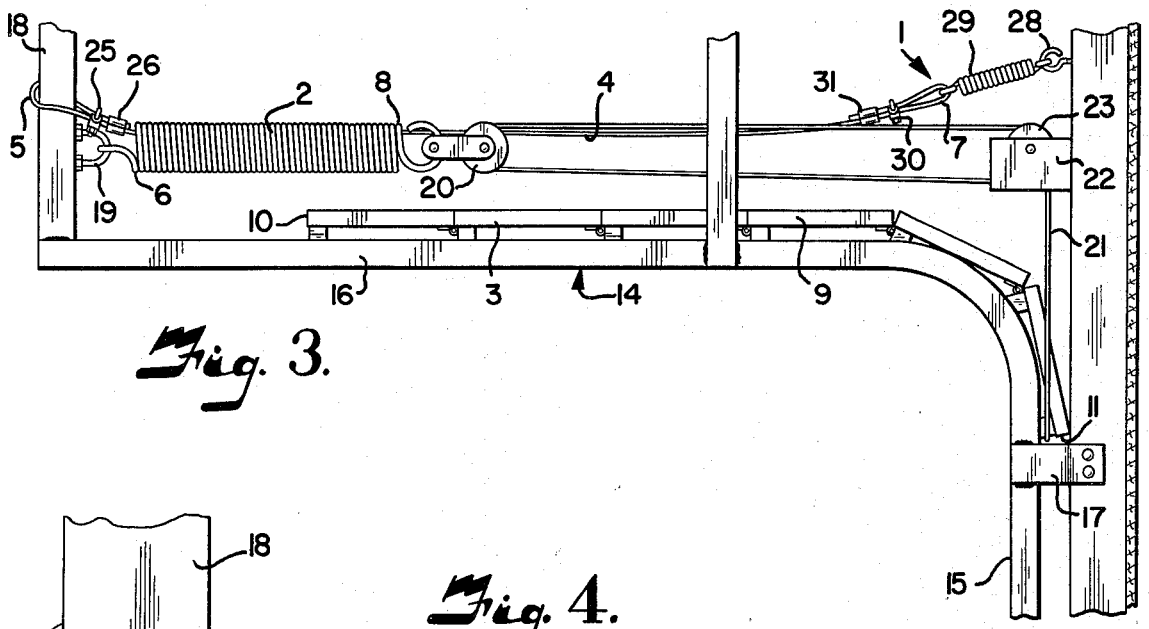
FIG. 3 is a side elevational view of the overhead garage door shown in an open position.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

In the disclosed embodiment of the present invention, the reference numeral 1 generally designates a safety device for use in combination with an elongated coil spring 2 substantially balancing an overhead garage door 3 for ease of opening and adapted to urge the overhead garage door 3 toward an open position after partial opening movement. The safety device 1 includes an elongated flexible member 4 extending longitudinally and substantially axially through the elongated spring 2 with ends thereof beyond the spring ends as with one end 5 thereof fixedly mounted adjacent a fixed end 6 of the spring 2. The other end 7 of the flexible member 4 is resiliently mounted adjacent the other end 8 of the spring 2 whereby separate portions of the spring 2 will be retained on the flexible member 4 in the event of breakage of the coil spring 2.

The opening closed by the overhead garage door 3 is defined by a pair of laterally spaced jamb members extending upwardly from a garage floor and a beam or lintel extending generally horizontally between upper ends of the jamb members.

The overhead garage door 3 may be any conventional garage door having opposite side edges 9 and top and bottom edges 10 and 11. The garage door 3 has a plurality of rollers 12 on each of the side edges 9 thereof and the rollers 12 are received in and movable along respective guide tracks 14.

Each of the guide tracks 14 has a lower generally upright portion 15 adapted to position the garage door 3 in a closed position. The guide tracks 14 each have an upper generally level portion 16 positioned above and connected to the upright portion 15 and adapted to position the garage door 3 in an open position, as is conventional.

The guide tracks 14 are each suitably held in position by one or more lower brackets 17 positioned adjacent and connected to the upright portion 15 of the respective guide track 14 and to the adjacent jamb member. An upper bracket 18 is positioned adjacent one end of the upper portion 16 of each of the guide tracks 14 to retain same in a fixed position. The brackets 17 and 18 are each suitably mounted on the structure of the building, house, or the like. In the illustrated embodiment, the brackets 17 are mounted on the respective jamb member in vertically spaced relation and the upper or end bracket 18 is mounted on and depends from a structural member in the ceiling of the garage.

The garage door 3 may have a single elongated spring 2 or one adjacent each of level portions 16 of the guide tracks 14. The elongated spring 2 is a coil spring and is positioned substantially parallel with the upper generally level portions 16 of the guide tracks 14. The one end 6 of the spring or springs 2 is fixably mounted on the upper bracket 18 in any suitable manner, such as by having a hook portion extending through a U-bolt 19 mounted on the upper bracket 18. The other end 8 of the elongated spring 2 is connected to a pulley 20 having a flexible member 21 received therein and having one connected to the door 3.

The flexible member 21 has the other end thereof connected to a bracket 22 suitably mounted on the structure of the building, house, or the like. The flexible member 21 extends from the bracket 22 and around the pulley 20 and a direction-changing pulley 23. The flexible member 21 has the one end thereof connected to the garage door 3 adjacent the bottom edge 11 thereof whereby the elongated coil spring or springs 2 urge the garage door 3 toward the open position, after partial opening movement.

The safety device 1 of the present invention includes the elongated flexible member 4 for and extending through each coil spring 2 and having the opposite ends 5 and 7 thereof mounted beyond respective opposite ends 6 and 8 of the respective coil spring 2. The elongated flexible member 4 may be any suitable member, such as a chain or a wire rope, such as is called an airplane cable, or the like.

Figure 4:
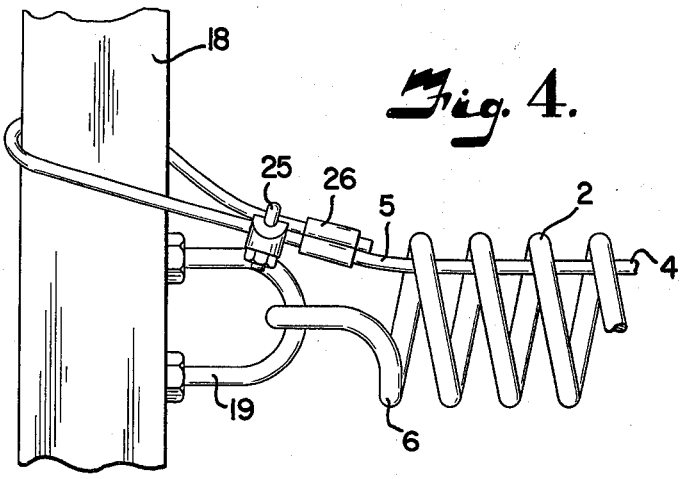
FIG. 4 is an enlarged side elevational view of one end of the safety device.

The one end 5 of the flexible member 4 is fixably mounted adjacent to and beyond the fixed end 6 of the respective coil spring 2 in any suitable manner. In the illustrated structure, the flexible member 4 extends around a portion of the upper bracket 18 and has a return portion thereof secured in position, as by a rope clamp 25. It is preferable to retain the free end of the return portion extending beyond the rope clamp 25, therefore, a suitable sleeve clamp 26 is mounted on respective portions of the flexible member 4 adjacent the one end 5 thereof, as best seen in FIG. 4.

The other end 7 of the flexible member 4 is resiliently mounted adjacent to and beyond the other end 8 of the respective coil spring 2 whereby separate portions of the coil spring 2 will be retained on the flexible member 4 in the event of breakage of the coil spring 2. In the illustrated structure, suitable support means, such as a screw eye 28, is mounted on a structural member of the building, house, or the like, such as a jamb member or lintel, and is preferably positioned adjacent and above the bracket 22. A suitable resilient member 29 has one end thereof mounted on the screw eye 28 and the other end of the resilient member 29 has the other end 7 of the flexible member 4 connected thereto.

Figure 5:
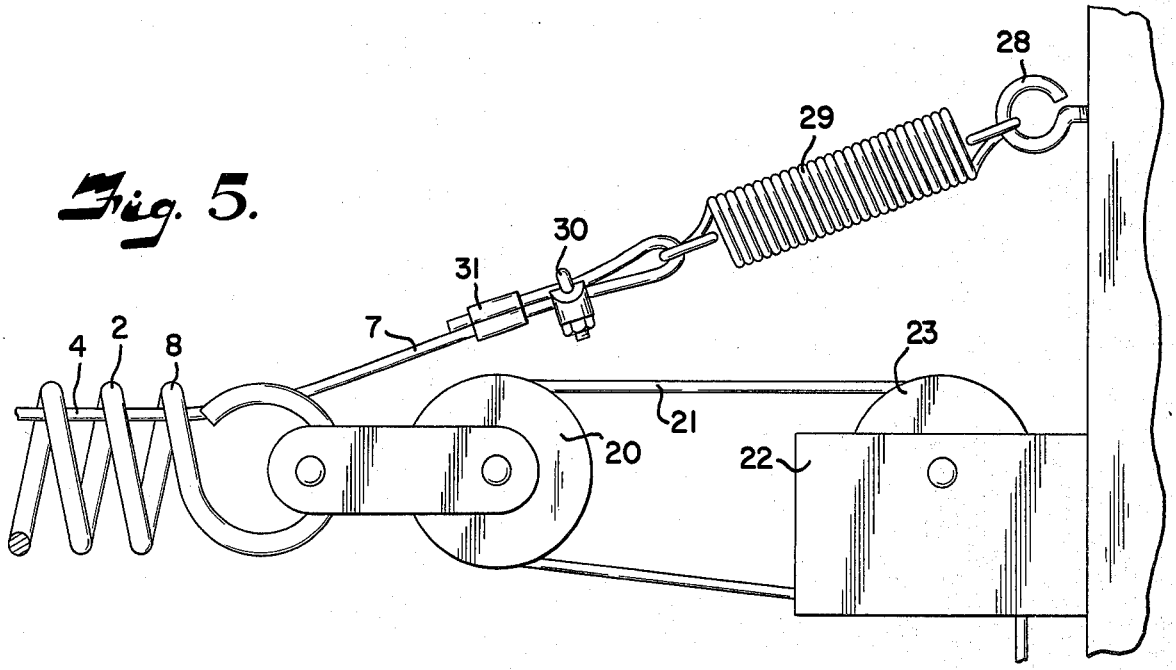
FIG. 5 is an enlarged side elevational view of the other end of the safety device.

In the illustrated embodiment, the flexible member 4 extends through an eye or loop of the resilient member 29 and a suitable rope clamp 30 connects adjacent portions of the elongated member 4 adjacent the other end of the resilient member 29. A free end of a return portion of the flexible member 4 is suitably secured to the remainder of the flexible member 4, as by a sleeve clamp 31, as best seen in FIG. 5.

It is to be understood that while I have illustrated and described one form of my invention, it is not to be limited to the specific form or arrangement of parts herein described and shown.

What I claim and desire to secure by Letters Patent is:

1. In a garage door structure having a door opening and a door movable between a closed position and an open position and means exerting force to maintain the door in open or closed position comprising:

a. guide tracks arranged adjacent sides of a door opening, said guide tracks each having a vertical section and a horizontal section connected to ane extending from said vertical section;

b. a door for closing said door opening, said door having rollers which are guided in the track sections for movement of the door between a closed vertical position and an open horizontal position;

c. a pair of elongate coiled springs each positioned generally horizontally and above a respective horizontal section of the guide tracks, said coiled springs each having open ends with one of said ends fixed relative to the respective guide track and the other ends connected through cables and pulleys to lower portions of the door whereby said coiled springs are stretched in variable degree by being elongated and acting as counterbalances as the door is moved to closed position;

d. an elongated flexible member of wire rope extending longitudinally through each coiled spring and having first and second end portions extending from said one and other ends respectively of said coiled springs, said flexible members being of a length greater than the extended length of the coiled springs in door operating positions;

e. means fixing said first end portions of the elongated flexible members to a respective guide track adjacent to and beyond said fixed one end of the respective coiled spring;

f. means connecting said second end portions of said elongated flexible members relative to a door structure adjacent to and beyond said other end of the respective coiled spring when said coiled springs are elongated in door closed position, said connecting means each including an extensible resilient member applying tension on the respective elongated flexible member, said coiled springs being sleeved on the respective elongated flexible members whereby said elongate flexible members are each adapted to support the respective coiled spring when same is in contracted position and in the event of breakage of a coiled spring the parts thereof are retained on the respective elongate flexible member.

2. A garage door structure as set forth in claim 1 wherein:

a. the extensible resilient members are each a coiled spring and the tension applied to the respective elongate flexible member holds it straight and in supporting position to the respective elongate coiled spring sleeved on said flexible member when the door is in open position and the elongate coiled spring is contracted.

* * * * *